US010054388B1

(12) United States Patent
Langner

(10) Patent No.: US 10,054,388 B1
(45) Date of Patent: Aug. 21, 2018

(54) METHODS AND APPARATUS FOR DISARMING AN EXPLOSIVE DEVICE

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 0 days.

(21) Appl. No.: 15/934,990

(22) Filed: Mar. 24, 2018

(51) Int. Cl.
*F41B 9/00* (2006.01)
*F42B 33/06* (2006.01)

(52) U.S. Cl.
CPC ..... *F41B 9/0046* (2013.01); *F41B 9/0075* (2013.01); *F42B 33/062* (2013.01)

(58) Field of Classification Search
CPC ..... F42B 33/062; F42B 33/06; F42B 33/00; F42B 12/02; F42B 9/0046; F42B 9/0075
USPC ..... 86/50; 89/1.13, 27.11; 124/56, 63, 64, 124/65, 74
See application file for complete search history.

(56) References Cited

U.S. PATENT DOCUMENTS 3,108,918 A * 10/1963 Plumley ..... F42B 33/062 216/103
3,358,935 A * 12/1967 Andersen ..... F02K 9/24 134/167 R
3,481,510 A * 12/1969 Allen, Jr. ..... A61M 5/24 222/327
3,724,372 A * 4/1973 Phillips ..... F42B 33/06 102/306
4,169,403 A * 10/1979 Hanson ..... F42B 33/062 102/293
4,757,629 A * 7/1988 Austin ..... F41A 19/59 42/84
5,136,920 A * 8/1992 Breed ..... F41A 23/06 102/430
5,210,368 A * 5/1993 Heller, Jr. ..... F41A 19/59 42/84
5,460,154 A * 10/1995 Mattern ..... B09B 3/0058 124/56
5,743,246 A * 4/1998 Mattern ..... B09B 3/0058 124/56
6,408,731 B1 * 6/2002 Elsener ..... F41A 1/10 102/440
6,439,127 B1 * 8/2002 Cherry ..... F42B 12/36 102/402
6,453,788 B1 * 9/2002 Lebet ..... F42B 1/02 102/306
6,896,204 B1 * 5/2005 Greene ..... F41B 9/0075 169/12
8,245,430 B1 * 8/2012 Owenby ..... F41A 19/69 42/84
8,915,004 B1 * 12/2014 Langner ..... F42B 33/06 124/65
9,200,881 B1 * 12/2015 Langner ..... F42B 33/06
9,217,613 B2 * 12/2015 Langner ..... F41A 25/06
(Continued)

*Primary Examiner* — Joshua E Freeman
(74) *Attorney, Agent, or Firm* — Lawrence Letham; Letham Law Firm LLC

(57) ABSTRACT

A disrupter cannon is used to disrupt or destroy explosive devices. A disrupter cannon may launch a liquid (e.g., water) toward an explosive device to disrupt the explosive device. The liquid may be launched through a nozzle. The nozzle may include passages that spread the liquid to for a column of liquid with a cross-section. A nozzle that provides a column of liquid with an oval cross-section may be more effective at disrupting certain types of explosive devices.

18 Claims, 5 Drawing Sheets

(56) References Cited

U.S. PATENT DOCUMENTS

| | | | | |
|---|---|---|---|---|
| 9,322,625 | B1 * | 4/2016 | Langner | F42B 33/062 |
| 9,404,718 | B1 * | 8/2016 | Shaver | F41B 9/0046 |
| 9,453,713 | B1 * | 9/2016 | Langner | F42B 33/06 |
| 9,488,429 | B1 * | 11/2016 | Langner | F41A 25/26 |
| 2003/0041722 | A1 * | 3/2003 | Alexander | F41B 11/00<br>86/50 |
| 2006/0254452 | A1 * | 11/2006 | Hunn | B26F 3/004<br>102/481 |
| 2009/0178548 | A1 * | 7/2009 | Tyas | F41B 9/0046<br>86/50 |
| 2012/0180644 | A1 * | 7/2012 | Langner | F41A 25/00<br>89/42.01 |
| 2014/0245878 | A1 * | 9/2014 | Langner | F41A 25/06<br>86/50 |

* cited by examiner

METHODS AND APPARATUS FOR DISARMING AN EXPLOSIVE DEVICE

FIELD OF THE INVENTION

Embodiments of the present disclosure relate to disrupter cannons used to disable explosive devices.

BRIEF DESCRIPTION OF THE DRAWING

Embodiments of the present disclosure will now be further described with reference to the drawing, wherein like designations denote like elements, and.

DETAILED DESCRIPTION OF THE PREFERRED EMBODIMENTS

Disrupter cannons are used by military, bomb squad, and other emergency service personnel to destroy and/or disable explosive devices including improvised explosive devices ("LED"), bombs, and ordinance.

Disrupter cannons propel a projectile to impact the explosive device. Impact of the projectile with the explosive device may interfere with (e.g., damage, destroy) a portion of the explosive device to disable the explosive device. Impact of the projectile with the explosive device may trigger (e.g., start, initiate, cause) explosion of the explosive device thereby destroying the device.

Some disrupter cannons launch a bullet-like projectile. Other disrupter cannons launch a projectile in the form of column of water from the bore of the barrel of the disrupter cannon.

Disrupter cannons may benefit from improving the effectiveness of using water as a projectile to disable an explosive device.

Figure 1:
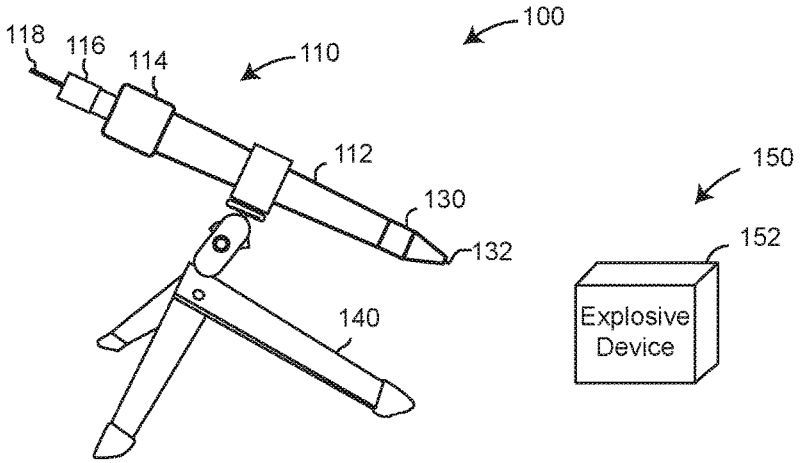
FIG. 1 is a diagram of a disrupter system, according to various aspects of the present disclosure, prior to launching a projectile at an explosive device.
Figure 2:
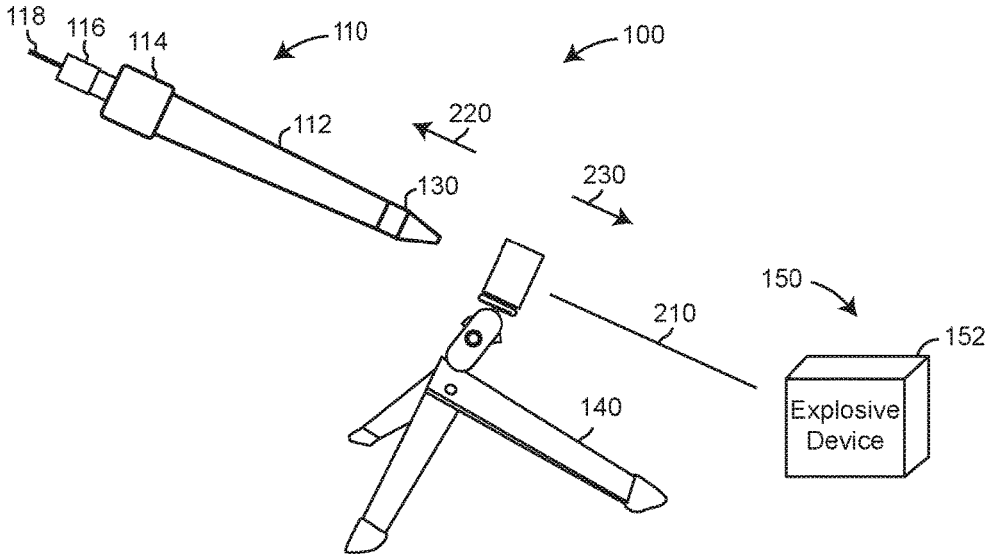
FIG. 2 is a diagram of the disrupter system of FIG. 1 just after launching the projectile at the explosive device.
Figure 3:
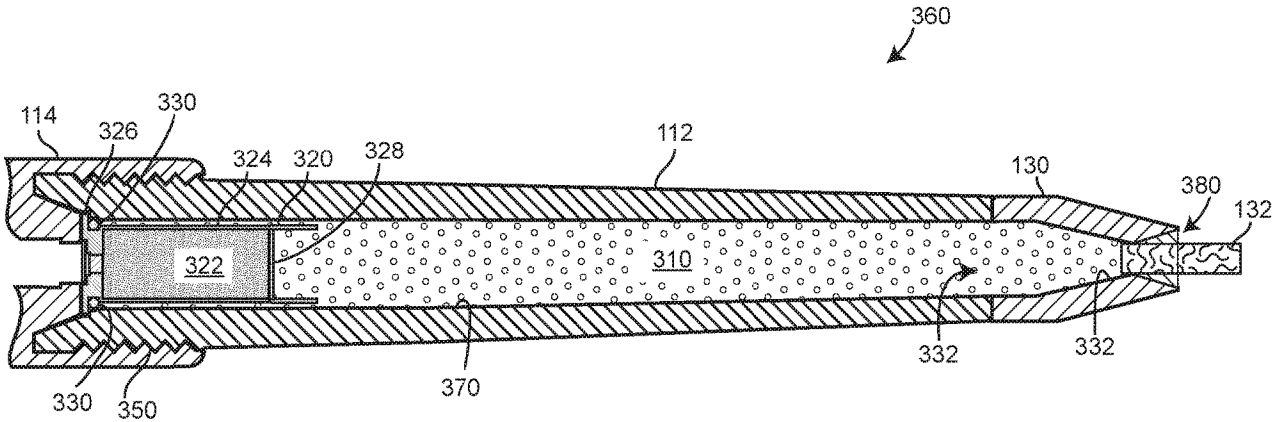
FIG. 3 is a cross-section of a portion of the disrupter cannon of FIG. 1 along a central axis.

For example, disrupter system 100 of FIG. 1 includes disrupter cannon 110 and support 140. Support 140 supports (e.g., holds) and positions disrupter cannon 110 prior to launching a projectile. Support 140 holds disrupter cannon 110 so that it may be aimed at explosive device 150. Aiming disrupter cannon 110 at explosive device 150 aligns the trajectory of the projectile launched by disrupter cannon 110 to strike explosive device 150 including housing 152 of explosive device 150. Housing 152 may include any container used to house the components of the explosive device.

Disrupter cannon may include barrel 112, breech 114, firing mechanism 116, shock tube 118, and nozzle 130. Barrel 112 includes a bore. Barrel 112 includes a breech end and a muzzle end. Barrel 112 may hold a projectile and a cartridge in the bore of barrel 112 prior to launch. Breech 114 couples to a breech-end portion of barrel 112 to contain and direct an explosive force (e.g., rapidly expanding gas) provided by the cartridge forward toward the muzzle end portion of barrel 112. Firing mechanism 116 couples to breech (e.g., breech cap) 114. Firing mechanism 116 includes a firing pin for activating the cartridge for providing the explosive force to launch a projectile from barrel 112. Shock tube 118 couples to firing mechanism 116. Shock tube 118 provides a force (e.g., rapidly expanding gas) to move the firing pin of firing mechanism 116 to strike the cartridge to activate the cartridge to provide the explosive force.

Upon activating the cartridge, projectile 210 is launched from the bore of barrel 112, out the muzzle-end portion of barrel 112, and forward in direction 230 toward explosive device 150. A force of recoil moves disrupter cannon 110 rearward out of and away from support 140 in direction 220, which is opposite direction 230.

In an implementation, shown as portion 360 of disrupter cannon 110, projectile 210 launched from disrupter cannon 110 is a liquid (e.g., water). Liquid 310 may be loaded into barrel 112 either via the beech end or the muzzle end of barrel 112.

To fill barrel 112 with liquid 310 via the breech, plug 132 is inserted in to the orifice 380 of nozzle 130. The inner cavities of nozzle 130 and barrel 112 are filled with liquid 310 via the open breech end while breech 114 is decoupled from barrel 112. The inner cavity of barrel 112 is defined by inner surface 370. The inner cavity of nozzle 130 is defined by inner surface 332. Plug 132 stops the exit of liquid 310 from orifice 380 of nozzle 130. After barrel 112 is filled with liquid 310, cartridge 320 is inserted into the breech end of barrel 112. Some portion of liquid 310 may exit barrel 112 as cartridge 320 displaces liquid 310 in barrel 112. Once cartridge 320 is inserted into the breech end portion of barrel 112, liquid 310 surrounds housing 324 of cartridge 320 and enters the open-end portion of cartridge 320 to contact cover 328 of cartridge 320.

Cartridge 320 is water resistant so that the water may directly contact and surround a major portion of housing 324 without permitting liquid to enter an interior of cartridge 320 to affect (e.g., degrade, corrupt, wet) pyrotechnic (e.g., power, explosive) 322. Liquid 310 directly contacts cover 328. Cover 328 is water resistant to resist the passage of water into an interior of cartridge 320.

Cartridge 320 includes seal 330 around an exterior of housing 324 of cartridge 320. When cartridge 320 is fully inserted into barrel 112, seal 330 contacts inner surface 370 of barrel 112 and an outer surface of cartridge 320 to form a seal between cartridge 320 and barrel 112 to reduce the passage of water from an interior of barrel 112 rearward of rim 326 of cartridge 320.

Once cartridge 320 is inserted into barrel 112, breech 114 may be coupled to barrel 112. Breech 114 may couple to barrel 112 using any type of coupling. In an implementation, breech 114 couples to barrel 112 using threads 350.

Barrel 112 may be fill with liquid via the muzzle end portion of barrel 112. To fill barrel 112 via the muzzle end, cartridge 320 may be inserted into barrel 112 and breech 114 coupled to barrel 112. Liquid 310 may fill barrel 112 and nozzle 130 via orifice 380 of nozzle 130 or barrel 112 may be filled via the muzzle end portion of barrel 112 while nozzle 130 is removed (e.g., decoupled) from barrel 112 then nozzle 130 attached to the muzzle end portion of barrel 112 and the interior of nozzle 130 fill with liquid 310 via orifice 380. Preferably, the interior (e.g., inner cavities) of barrel 112 and nozzle 130 are filled with liquid 310 leaving little or no air inside barrel 112 or nozzle 130.

When barrel 112 is filled from the muzzle end, liquid 310 surrounds and directly contacts the exterior of housing 324 and cover 328 of cartridge 320. Because the outer diameter of housing 324 is less than the inner diameter of barrel 112, liquid 310 is positioned between the outer surface of housing 324 and inner surface 370 of barrel 112. Further, liquid 310 is positioned forward of cartridge 320 and is in direct contact with cover 328. Once the interior cavities of barrel 112 and nozzle 130 have been filled, plug 132 may be inserted into orifice 380 to reduce leakage of liquid 310 from orifice 380 prior to launching the liquid from barrel 112 and nozzle 130.

Nozzle 130 may couple to barrel 112 in any manner. In one implementation, nozzle 130 threadedly (not shown) couples to barrel 112.

When cartridge 320 is ignited (e.g., initiated), pyrotechnic 322 burns to produce a rapidly expanding gas. The rapidly expanding gas forces cover 328 out of cartridge 320 so that the force from the rapidly expanding gas is directly applied to liquid 310. The force of the rapidly expanding gas moves liquid 310 forward toward orifice 380. The movement of liquid 310 forward applies a force on plug 132 that pushes plug 132 out of orifice 380. Because the liquid exits out orifice 380 to launch the liquid, orifice 380 may also be referred to as an exit or an outlet. Once plug 132 is remove (e.g., pushed) from orifice 380, the force from the rapidly expanding gas on liquid 310 forces liquid 310 from barrel 112 into inlet 382 of nozzle 130 and out through orifice 380 of nozzle 130.

The shape of nozzle 130, referring to FIGS. 1-3 and 6-9 determines the shape of column of liquid (e.g., projectile) 210 that exits barrel 112 and nozzle 130 and the force with which liquid 310 exits orifice 380. In an implementation, a diameter of orifice 380 is less than an inner diameter of barrel 112 and the orifice (e.g., outlet, exit) F380 includes central channel 612 and two side channels 614 and 616 that splays (e.g., spreads out) column 210.

Diameter 830 of nozzle 130 is about the same as the inner diameter of nozzle 130 proximate to the muzzle end portion of barrel 112. In another implementation, diameter 830 could be less than the inner diameter of barrel 112. Diameter 730 is the diameter of central channel 612. Diameter 830 is about the same as the inner diameter of barrel 112 at the muzzle end portion of barrel 112. As liquid 310 is forced from barrel 112 by the rapidly expanding gas, the diameter of the passage decreases from diameter 830 to diameter 730. The decrease in diameter causes the force (e.g., pressure) of exiting liquid 310 to increase.

Diameter 730 occurs at location 840 in nozzle 130. Diameter 730 is the narrowest diameter of nozzle 130 and the narrowest diameter of orifice 380. In an implementation, the diameter of nozzle 130 through orifice 380 remains constant (e.g., eliminate side channels 614 and 616) along the passage from location 840 to location 842. Orifice 380 of constant diameter would produce a column of water with a circular cross section.

In the implementation show in FIGS. 3 and 6-9, orifice 380 from location 840 to location 842 includes central channel 612 and two side channels 614 and 616. Central channel is positioned axially around axis 740. Axis 740 may be central to nozzle 130. The diameter of central channel is diameter 730. Side axis 614 has start (e.g., inlet) 850 and end (e.g., outlet) 852. Side axis 616 has start (e.g., inlet) 860 and end (e.g., outlet) 862. Start 850 and start 860 begin at location 840. At location 840, side channel 614 and side channel 616 start to open from central channel 612. At location 840, liquid may enter start 850 and start 860 to travel out nozzle via side channel 614 and side channel 616 respectively. Liquid that enters side channel 614 and side channel 616 via start 850 and 860 respectively exit side channel 614 and side channel 616 at end 852 and end 862 respectively. Liquid exiting end 852 and end 862 form the sides of the oval cross-section of the liquid that exits nozzle 130.

Figure 6:
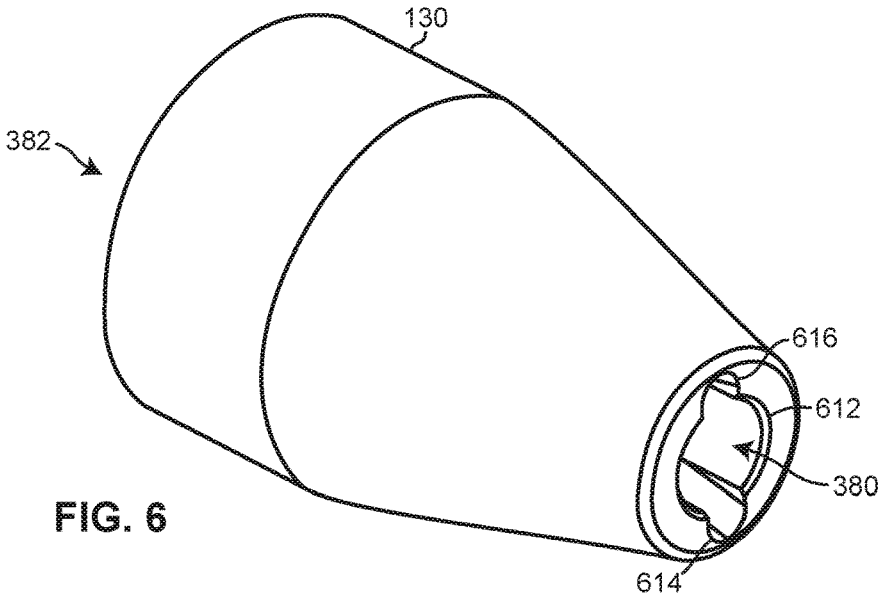
FIG. 6 is a perspective view of a nozzle according to various aspects of the present disclosure.
Figure 7:
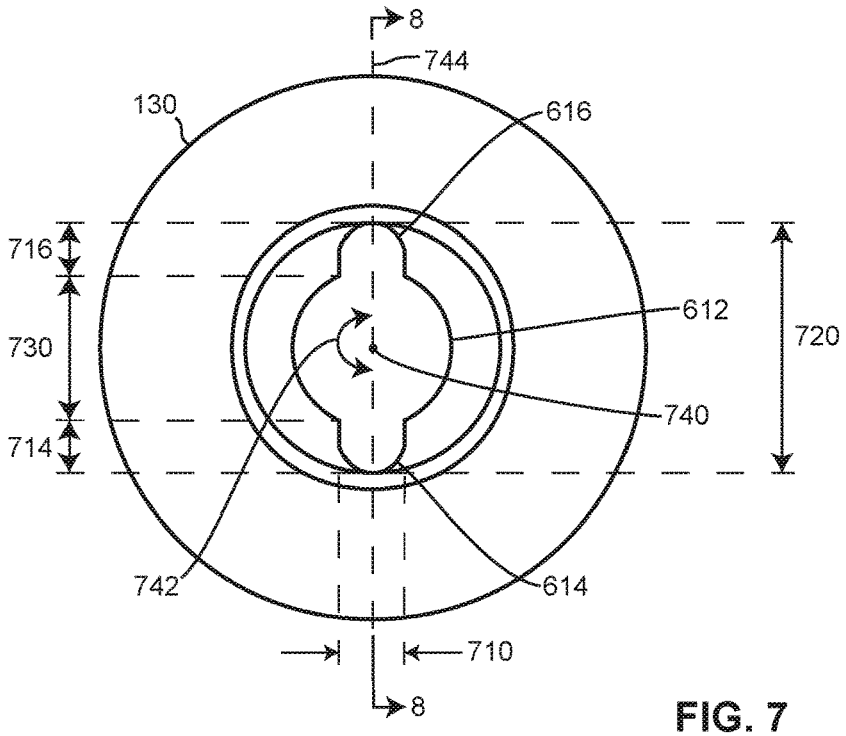
FIG. 7 is a front view of the nozzle of FIG. 6.
Figure 8:
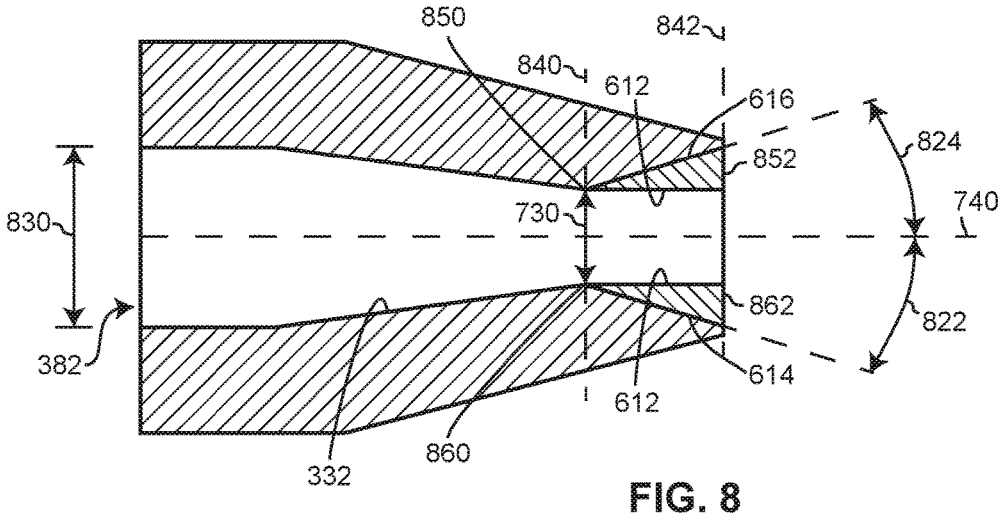
FIG. 8 is a cross-section of the nozzle of FIG. 7 along 8-8.

Side channels 614 and 616 extend from central channel 612 at angle 822 and 824 with respect to axis 740. Axis 740 is positioned along center line 744. Side channels 614 and 616 have width 710 respectively. Side channels 614 and 616 are open to central channel 612 along the length of central channel 612 (e.g., from location 840 to location 842). Central channel 612, side channel 614, and side channel 616 merge to provide an opening with a central portion (e.g., central channel 612) and two side portions (e.g., lobes) joined to the central portion as shown in FIGS. 6-8.

Side channels 614 and 616 cause a liquid to splay as it exits orifice 380. The amount of spread of the liquid from orifice 380 depends on the angle (e.g., 822, 824), width 710, and height (e.g., 714 and 716) of side channels 614 and 616. The amount of spread increases as angle 822 and 824 increases, width 710 increases, and/or height 714 and 716 increases. One side channel may increase the spread of the liquid more than the other side. For example, side channel 614 will increase the spread of the liquid on the side of side channel 614 if height 714 and angle 822 is greater than height 716 and angle 824 and vice versa. Angle 822 and angle 824 may be in the range of 7 degrees to 15 degrees respectively.

In an implementation, angle 822 is about 11.5 degrees and angle 824 is about 11.5 degrees so that the combination of angle 822 and 824 is about 23 degrees. Diameter 730 is about 0.3125 inches, width 710 is about 0.135 inches, height 714 is about 0.113 inches, and height 716 is about 0.113 inches. The above dimensions mean that dimension 720 is about 0.5385 inches. A nozzle formed using the above dimensions produces a column of water that has an oval cross-section. The height of the oval (e.g., along axis 1070) at the exit (e.g., 842) of the nozzle is about 0.3125 inches (e.g., 730) and the width of the oval (e.g., along axis 1060) is about 0.5385 inches (e.g., 720). The height to width ratio (e.g., 730/720) remains about the same as the oval increases in area as it travels away from the nozzle.

When viewing the front of nozzle 130 (e.g., refer to FIG. 7), side channel 614 is positioned with respect to side channel 616 at angle 742. Angle 742 lines in a plane that is perpendicular to axis 740. In an implementation, angle 742 is 180 degrees, so side channel 614 is positioned diametrically (e.g., directly, 180 degrees) opposite side channel 616 across axis 740. In another implementation, angle 742 is less than 180 degrees in a range of between 90 and 179 degrees. Angle 742 determines a shape of the cross-section of the liquid that exits nozzle 130. When angle 742 is about 180 degrees, the cross-section of the liquid is oval. When angle 742 is about 90 degrees, the shape of the cross-section of the liquid approximates a "V" shape.

Figure 9:
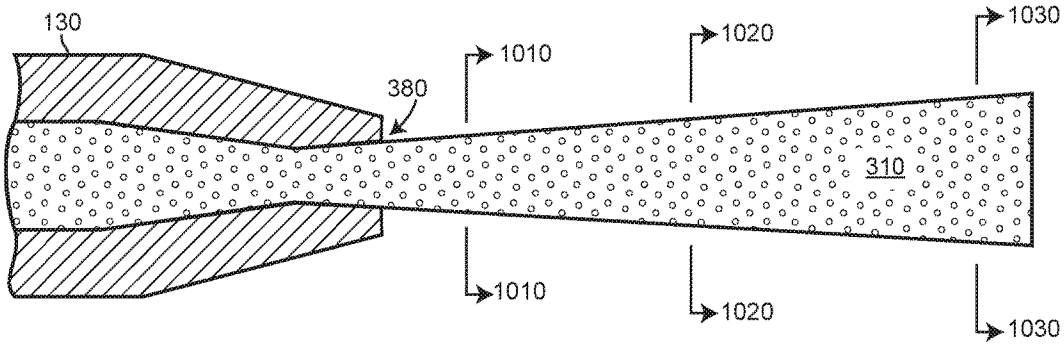
FIG. 9 is a diagram of the nozzle of FIG. 8 ejecting a liquid.
Figure 4:
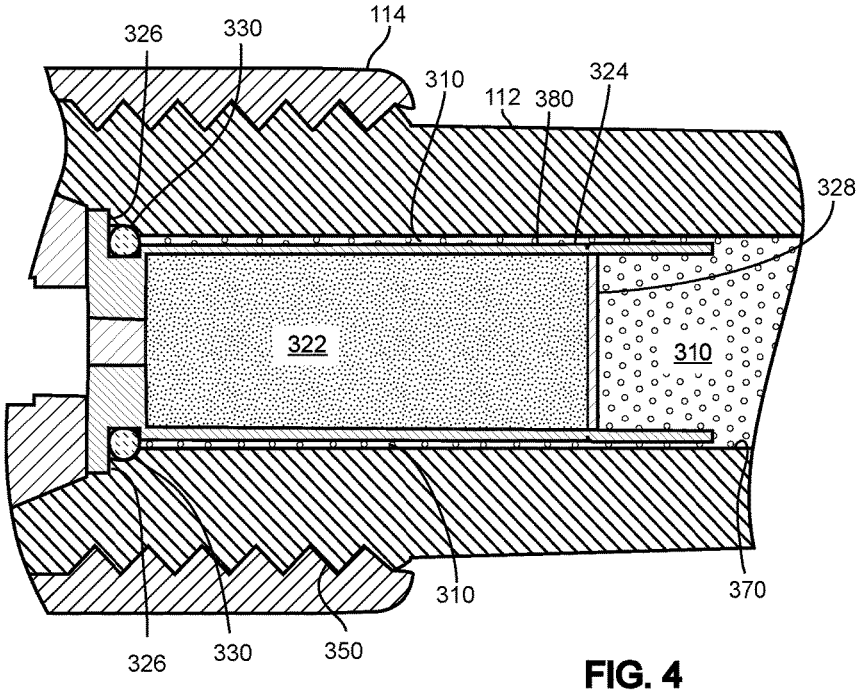
FIG. 4 is a close-up of a portion of the cross-section of FIG. 3.
Figure 5:
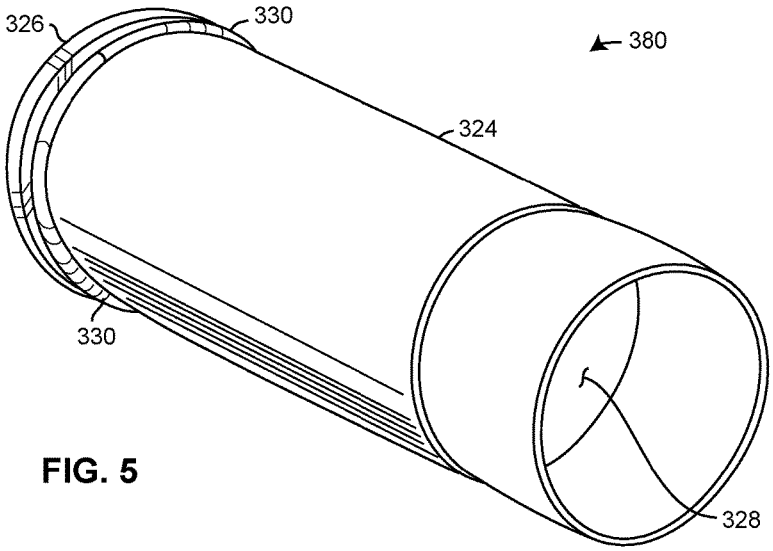
FIG. 5 is a diagram of a cartridge.

The column of liquid exiting nozzle 130, referring to FIG. 9, increases in diameter as a function of the distance from the exit of nozzle 130. Column of liquid (e.g., water) 210 will increase in diameter as a function of the distance from the nozzle regardless of the shape of orifice 380. The cross-section of column of liquid 210 provided via a nozzle with only central channel 612 and no side channels 614 and 616 will be a circle that increases in diameter the farther the column travels from the nozzle.

Figure 10:
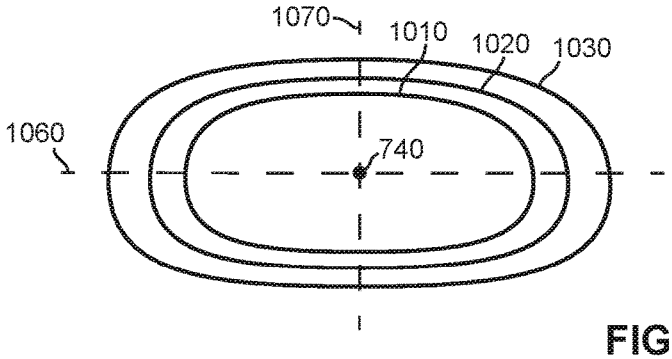
FIG. 10 is a cross-section of the liquid at various locations along the stream of the liquid.

Nozzle 130 a show in FIGS. 3 and 6-9 that includes central channel 612, side channel 614 and side channel 616 produces a column of liquid (e.g., column 210) with a cross-section that is oval. Liquid 310 exits nozzle 130 as shown in FIG. 9. The cross-sections of liquid 310 at locations marked 1010, 1020, and 1030 are shown in FIG. 10. Side channels 614 and 616 splay the liquid exiting nozzle 130 so that the cross-section of the column of water is oval. The width of oval 1010 along axis 1060 is greater than the height of oval 1010 along axis 1070. In an implementation, the width of the cross-section (e.g., along axis 1060) is between 1.5 to 3 times greater than the height of the cross-section (e.g., along axis 1070).

The width and height of the liquid exiting nozzle 130 increases as the distance from nozzle 130. As shown in FIG. 10, the width and height of oval 1020 is greater than the width and height of oval 1010 because 1020 is further away from nozzle 130. The same applies to oval 1030 with respect to oval 1020.

In an implementation of nozzle 130 with the dimensions provided above, the width of the cross-section (e.g., along axis 1060) is about 1.5 inches at 10 inches away from nozzle 130 and about 5 inches at 46 inches away from nozzle 130.

Practice in the field has shown that a nozzle that produces a column of water with a circular cross-section is more effective against some explosive devices while a nozzle that produces a column of water with an oval cross-section is more effective against other explosive devices.

For example, a column of water with a circular cross-section can effectively pierce a car door or a wind shield of a car to destroy target resting on the seat or dash board of the car. However, a column of water with a circular cross-section is less effective against an explosive device in an ammunition box because the column can enter and exit the ammunition box without causing much damage to the ammunition box. For example, aiming the column of water with a circular cross-section at the hinge on the lid of the ammunition box will puncture a hole in a portion of the hinge, but leave the remainder of the hinge intact and coupled to the box. The same result occurs with explosive devices made of pressure cookers or suit cases. The column of water with the circular cross-section passes through the container doing only minimal damage to the explosive device.

When a column of water with an oval cross-section strikes (e.g., impacts, hits) the hinge on an ammunition box, because the cross-section of the column is wider and its area of impact is greater, it disrupts (e.g., destroys) a much larger portion of the hinge and generally separates the hinge from the ammunition box so that the lid of the ammunition box is removed from the ammunition box and the contents of the explosive device are thrown from the box.

A column of water with an oval cross-section is also more effective at disabling an explosive device formed of a pressure cooker because the larger cross-section of the column of water separates the lid of the pressure cooker from the bowl of the pressure cooker when aimed at the couplings between the lid and the bowl. A column of water with an oval cross-section is more effective at disrupting the latches on suitcases or other containers to open the suitcase or container.

The foregoing description discusses embodiments, which may be changed or modified without departing from the scope of the present disclosure as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments have been described, the scope of the invention is intended to be measured by the claims as set forth below. In the claims, the term "provided" is used to definitively identify an object that not a claimed element but an object that performs the function of a workpiece. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

The location indicators "herein", "hereunder", "above", "below", or other word that refer to a location, whether specific or general, in the specification shall be construed to refer to any location in the specification whether the location is before or after the location indicator.

What is claimed is:

1. A disrupter cannon for launching a liquid toward a provided explosive device to disable the explosive device, the disrupter cannon comprising:

a barrel having a bore, a breech-end portion, and a muzzle-end portion, the breech-end portion configured to receive a provided cartridge, the bore having a first diameter, the bore configured to hold the liquid;

a breech configured for coupling to the breech-end portion of the barrel;

a nozzle having an orifice, the orifice includes a central channel, a first side channel, and a second side channel, the nozzle configured for coupling to the muzzle-end portion of the barrel, the central channel of the orifice having a second diameter; wherein:

prior to igniting the cartridge:

the cartridge is positioned in the breech-end portion of the barrel;

the liquid fills the bore and the nozzle; and the liquid contacts the cartridge;

the second diameter is less than the first diameter;

a rapidly expanding gas from the cartridge applies a force directly to the liquid to force the liquid from the bore and the nozzle through the orifice toward the explosive device; and the first side channel and the second side channel spread the liquid to provide a column of water having an oval cross-section.

2. The disrupter cannon of claim 1 wherein the first side channel positioned on a first side of a central axis and the second side channel positioned along a second side of the central axis.

3. The disrupter cannon of claim 1 wherein the first side channel positioned on a first side of a central axis and the second side channel positioned along a second side of the central axis, the first side is opposite the second side.

4. The disrupter cannon of claim 1 wherein a ratio of a width of the oval cross-section to a height of the oval cross-section is about 1.7.

5. The disrupter cannon of claim 1 wherein a ratio of a width of the oval cross-section to a height of the oval cross-section is in a range between 1.5 and 2.

6. A disrupter cannon for launching a liquid toward a provided explosive device to disable the explosive device, the disrupter cannon comprising:

a barrel having a bore, a breech-end portion, and a muzzle-end portion, the breech-end portion configured to receive a provided cartridge, the bore configured to hold the liquid;

a nozzle having an inlet and an outlet, the inlet coupled to the muzzle-end portion of the barrel, the outlet having a central channel, a first side channel, and a second side channel; wherein:

the central channel is positioned along an axis between the inlet and the outlet;

the first side channel open along the central channel at a first angle with respect to the axis;

the second side channel open along the central channel at a second angle with respect to the axis;

a rapidly expanding gas from the cartridge applies a force to the liquid to force the liquid from the bore and through the nozzle; and the liquid exits the central channel, the first side channel, and the second side channel to form a column of having a cross-section.

7. The disrupter cannon of claim 6 wherein the axis is positioned centrally between the inlet and the outlet.

8. The disrupter cannon of claim 6 wherein:

the inlet has a first diameter;

the central channel has a second diameter; and the first diameter is greater than the second diameter.

9. The disrupter cannon of claim 6 wherein the first angle is between 7.5 degrees and 15 degrees.

10. The disrupter cannon of claim 6 wherein the second angle is between 7.5 degrees and 15 degrees.

11. The disrupter cannon of claim 6 wherein:

the first angle is 11.5 degrees;

the second angle is 11.5 degrees; and a shape of the cross-section is an oval.

12. The disrupter cannon of claim 6 wherein:

the central channel having a diameter;

the first side channel having a first width;

the second side channel having a second width;

the first width is less than the diameter; and the second width is less than the diameter.

13. A disrupter cannon for launching a liquid toward a provided explosive device to disable the explosive device, the disrupter cannon comprising:

a barrel having a bore, a breech-end portion, and a muzzle-end portion, the breech-end portion configured to receive a provided cartridge, the bore having a first diameter, the bore configured to hold the liquid;

a breech configured for coupling to the breech-end portion of the barrel;

a nozzle having a central channel, a first side channel, and a second side channel, the nozzle configured for coupling to the muzzle-end portion of the barrel; wherein:

the central channel is positioned along an axis;

the first side channel positioned at a first angle with respect to the axis;

the second side channel positioned at a second angle with respect to the axis;

the first side channel and the second side channel open to the central channel along a length of the central channel;

the first side channel positioned at a third angle with respect to the second side channel;

prior to igniting the cartridge:

the cartridge is positioned in the breech-end portion of the barrel;

the liquid fills the bore and the nozzle; and the liquid contacts the cartridge;

a rapidly expanding gas from the cartridge applies a force directly to the liquid to force the liquid from the bore and the nozzle through the central channel, the first side channel, and the second side channel toward the explosive device; and the first side channel and the second side channel spread the liquid to provide a column of water having cross-section.

14. The nozzle of claim 13 wherein:

the first angle is 11.5 degrees;

the second angle is 11.5 degrees;

the third angle is 180 degrees; and a shape of the cross-section is an oval.

15. The nozzle of claim 13 wherein the first angle is between 7.5 degrees and 15 degrees.

16. The nozzle of claim 13 wherein the second angle is between 7.5 degrees and 15 degrees.

17. The nozzle of claim 13 wherein first side channel is positioned opposite the second side channel.

18. The nozzle of claim 13 wherein the third angle is 180 degrees.

* * * * *